US010665200B2

(12) United States Patent
Pyun et al.

(10) Patent No.: US 10,665,200 B2
(45) Date of Patent: May 26, 2020

(54) DRIVING VOLTAGE PROVIDER AND DISPLAY DEVICE INCLUDING THE SAME

(71) Applicant: Samsung Display Co., Ltd., Yongin-si (KR)

(72) Inventors: Ki Hyun Pyun, Yongin-si (KR); Eui Myeong Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/361,168

(22) Filed: Mar. 21, 2019

(65) Prior Publication Data

US 2020/0043437 A1 Feb. 6, 2020

(30) Foreign Application Priority Data

Jul. 31, 2018 (KR) ..... 10-2018-0089295

(51) Int. Cl.
*G09G 3/36* (2006.01)
*G09G 3/3258* (2016.01)

(52) U.S. Cl.
CPC ..... *G09G 3/3696* (2013.01); *G09G 3/3258* (2013.01); *G09G 2320/043* (2013.01); *G09G 2330/025* (2013.01)

(58) Field of Classification Search
CPC ..... G09G 3/3696; G09G 3/3258; G09G 2330/025; G09G 2320/043; H05B 41/3927
See application file for complete search history.

(56) References Cited

U.S. PATENT DOCUMENTS

2014/0159686 A1* 6/2014 Lee ..... H02M 3/156 323/282
2017/0308107 A9 10/2017 Duong
2017/0337890 A1 11/2017 Lee et al.
2018/0033384 A1 2/2018 Kim et al.

FOREIGN PATENT DOCUMENTS

KR 10-2017-0003795 1/2017
KR 10-2017-0130676 11/2017

* cited by examiner

*Primary Examiner* — Abbas I Abdulselam
(74) *Attorney, Agent, or Firm* — H.C. Park & Associates, PLC

(57) ABSTRACT

A display device includes: a driving voltage provider for generating a PWM signal according to the frequency of a clock signal, and providing a driving voltage generated according to the duty ratio of the PWM signal to at least one of the pixels, the data driver, and the scan driver. The driving voltage provider tunes the frequency of the clock signal to a first frequency in a first section, tunes the frequency of the clock signal to a second frequency smaller than the first frequency in a second section in which the magnitude of a driving voltage is larger than that in the first section, and tunes the frequency of the clock signal to a third frequency larger than the first frequency in a third section in which the magnitude of a driving voltage is smaller than that in the first section.

18 Claims, 11 Drawing Sheets

| INPUT | | | | | | | | OUTPUT | | |
|---|---|---|---|---|---|---|---|---|---|---|
| Ci1 | Ci2 | Ci3 | Ci4 | Ci5 | Ci6 | Ci7 | Ci8 | Co1 | Co2 | Co3 |
| 0 | 0 | 0 | 0 | 0 | 0 | 0 | 1 | 0 | 0 | 0 |
| 0 | 0 | 0 | 0 | 0 | 0 | 1 | 1 | 0 | 0 | 1 |
| 0 | 0 | 0 | 0 | 0 | 1 | 1 | 1 | 0 | 1 | 0 |
| 0 | 0 | 0 | 0 | 1 | 1 | 1 | 1 | 0 | 1 | 1 |
| 0 | 0 | 0 | 1 | 1 | 1 | 1 | 1 | 1 | 0 | 0 |
| 0 | 0 | 1 | 1 | 1 | 1 | 1 | 1 | 1 | 0 | 1 |
| 0 | 1 | 1 | 1 | 1 | 1 | 1 | 1 | 1 | 1 | 0 |
| 1 | 1 | 1 | 1 | 1 | 1 | 1 | 1 | 1 | 1 | 1 |

| INPUT | | | OUTPUT | |
|---|---|---|---|---|
| Co1 | Co2 | Co3 | DIVIDER VALUE | CLK |
| 0 | 0 | 0 | 8 | R_CLK*8 |
| 0 | 0 | 1 | 7 | R_CLK*7 |
| 0 | 1 | 0 | 6 | R_CLK*6 |
| 0 | 1 | 1 | 5 | R_CLK*5 |
| 1 | 0 | 0 | 4 | R_CLK*4 |
| 1 | 0 | 1 | 3 | R_CLK*3 |
| 1 | 1 | 0 | 2 | R_CLK*2 |
| 1 | 1 | 1 | 1 | R_CLK*1 |

| INPUT | | | OUTPUT | | | | | | | |
|---|---|---|---|---|---|---|---|---|---|---|
| Co1 | Co2 | Co3 | S1 | S2 | S3 | S4 | S5 | S6 | S7 | S8 |
| 0 | 0 | 0 | 0 | 0 | 0 | 0 | 0 | 0 | 0 | 1 |
| 0 | 0 | 1 | 0 | 0 | 0 | 0 | 0 | 0 | 1 | 0 |
| 0 | 1 | 0 | 0 | 0 | 0 | 0 | 0 | 1 | 0 | 0 |
| 0 | 1 | 1 | 0 | 0 | 0 | 0 | 1 | 0 | 0 | 0 |
| 1 | 0 | 0 | 0 | 0 | 0 | 1 | 0 | 0 | 0 | 0 |
| 1 | 0 | 1 | 0 | 0 | 1 | 0 | 0 | 0 | 0 | 0 |
| 1 | 1 | 0 | 0 | 1 | 0 | 0 | 0 | 0 | 0 | 0 |
| 1 | 1 | 1 | 1 | 0 | 0 | 0 | 0 | 0 | 0 | 0 |

DRIVING VOLTAGE PROVIDER AND DISPLAY DEVICE INCLUDING THE SAME

CROSS REFERENCE TO RELATED APPLICATION

This application claims priority from and the benefit of Korean Patent Application No. 10-2018-0089295, filed on Jul. 31, 2018, which is hereby incorporated by reference for all purposes as if fully set forth herein.

BACKGROUND

Field

Exemplary embodiments of the invention relate generally to a driving voltage provider and a display device including the same.

Discussion of the Background

With the development of information technologies, the importance of a display device which is a connection medium between a user and information increases. Accordingly, display devices such as a liquid crystal display device, an organic light emitting display device, and a plasma display device are increasingly used.

A display device may include a driving voltage provider for providing a driving voltage. The driving voltage provider may be provided in the form of a so-called Power Management Integrated Circuit (PMIC).

A trade-off relationship exists between a ripple and thermal stress of a driving voltage provided by the driving voltage provider, and therefore, appropriate balancing is required between the ripple and thermal stress of the driving voltage.

The above information disclosed in this Background section is only for understanding of the background of the inventive concepts, and, therefore, it may contain information that does not constitute prior art.

SUMMARY

Devices constructed according to exemplary embodiments of the invention provide a driving voltage provider capable of compensating for a ripple and minimizing thermal stress, adaptively with respect to a fluctuation of a load to which the driving voltage is provided.

Additional features of the inventive concepts will be set forth in the description which follows, and in part will be apparent from the description, or may be learned by practice of the inventive concepts.

According to an exemplary embodiment, a display device includes: pixels coupled to data lines and scan lines; a data driver configured to provide data voltages through the data lines; a scan driver configured to provide scan signals through the scan lines, to select at least some of the pixels in which the data voltages are to be written; and a driving voltage provider configured to generate a pulse width modulation (PWM) signal according to the frequency of a clock signal, and provide a driving voltage generated according to the duty ratio of the PWM signal to at least one of the pixels, the data driver, and the scan driver, wherein the driving voltage provider tunes the frequency of the clock signal to a first frequency in a first section, tunes the frequency of the clock signal to a second frequency smaller than the first frequency in a second section in which the magnitude of a driving voltage is larger than that in the first section, and tunes the frequency of the clock signal to a third frequency larger than the first frequency in a third section in which the magnitude of a driving voltage is smaller than that in the first section.

The driving voltage provider may further include a voltage comparator configured to measure a magnitude of the driving voltage in each of the first section, the second section, and the third section.

The voltage comparator may be operated in the first section, the second section, and third section by using, as a control signal, logic levels of a vertical synchronization signal and a scan start signal.

The voltage comparator may be operated in the first section when the vertical synchronization signal has a first level and the scan start signal has a second level, be operated in the second section when the vertical synchronization signal has a third level different from the first level and the scan start signal has the second level, and be operated in the third section when the vertical synchronization signal has the first level and the scan start signal has a fourth level different from the second level.

The voltage comparator may include: comparators to which the driving voltage and different reference voltages are input; and an encoder configured to encode outputs of the comparators according to the logic levels of the vertical synchronization signal and the scan start signal.

The driving voltage provider may further include a phase locked loop (PLL) circuit configured to generate the clock signal of which frequency is tuned by tuning a divider value corresponding to an output value of the encoder.

The driving voltage provider may further include a compensation circuit coupled to a first node to which the driving voltage is provided, the compensation circuit determining a response speed with respect to the driving voltage.

The compensation circuit may tune the response speed to a first speed in the first section, tune the response speed to a second speed slower than the first speed in the second section, and tune the response speed to a third speed faster than the first speed in the third section.

The compensation circuit may include resistors and capacitors. At least some of the resistors and the capacitors may be coupled to the first node to have a time constant corresponding to the first speed in the first section, at least some of the resistors and the capacitors may be coupled to the first node to have a time constant corresponding to the second speed in the second section, and at least some of the resistors and the capacitors may be coupled to the first node to have a time constant corresponding to the third speed in the third section.

The display device may further include a timing controller configured to control the data driver, the scan driver, and the driving voltage provider. The driving voltage provider may further include: a first memory configured to output a digital value under the control of the timing controller; and a digital-analog converter configured to convert the digital value into the reference voltages.

The driving voltage provider may further include a second memory configured to store output values of the voltage comparator in the first section, the second section, and the third section by using, as a control signal, the logic levels of the vertical synchronization signal and the scan start signal.

According to an aspect of the present disclosure, there is provided a driving voltage provider including: a PLL circuit configured to generate a clock signal; and a DC-DC converter configured to generate a PWM signal according to the frequency of the clock signal, and generate a driving voltage according to the duty ratio of the PWM signal, wherein the driving voltage provider tunes the frequency of the clock signal to a first frequency in a first section, tunes the frequency of the clock signal to a second frequency smaller than the first frequency in a second section in which the magnitude of a driving voltage is larger than that in the first section, and tunes the frequency of the clock signal to a third frequency larger than the first frequency in a third section in which the magnitude of a driving voltage is smaller than that in the first section.

The driving voltage provider may further include a voltage comparator configured to measure a magnitude of the driving voltage in each of the first section, the second section, and the third section.

The voltage comparator may include: comparators to which the driving voltage and different reference voltages are input; and an encoder configured to encode outputs of the comparators.

The PLL circuit may generate the clock signal of which frequency is tuned by tuning a divider value corresponding to an output value of the encoder.

The driving voltage provider may further include a compensation circuit coupled to a first node to which the driving voltage is provided, the compensation circuit determining a response speed with respect to the driving voltage.

The compensation circuit may tune the response speed to a first speed in the first section, tune the response speed to a second speed slower than the first speed in the second section, and tune the response speed to a third speed faster than the first speed in the third section.

The compensation circuit may include resistors and capacitors. At least some of the resistors and the capacitors may be coupled to the first node to have a time constant corresponding to the first speed in the first section, at least some of the resistors and the capacitors may be coupled to the first node to have a time constant corresponding to the second speed in the second section, and at least some of the resistors and the capacitors may be coupled to the first node to have a time constant corresponding to the third speed in the third section.

It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
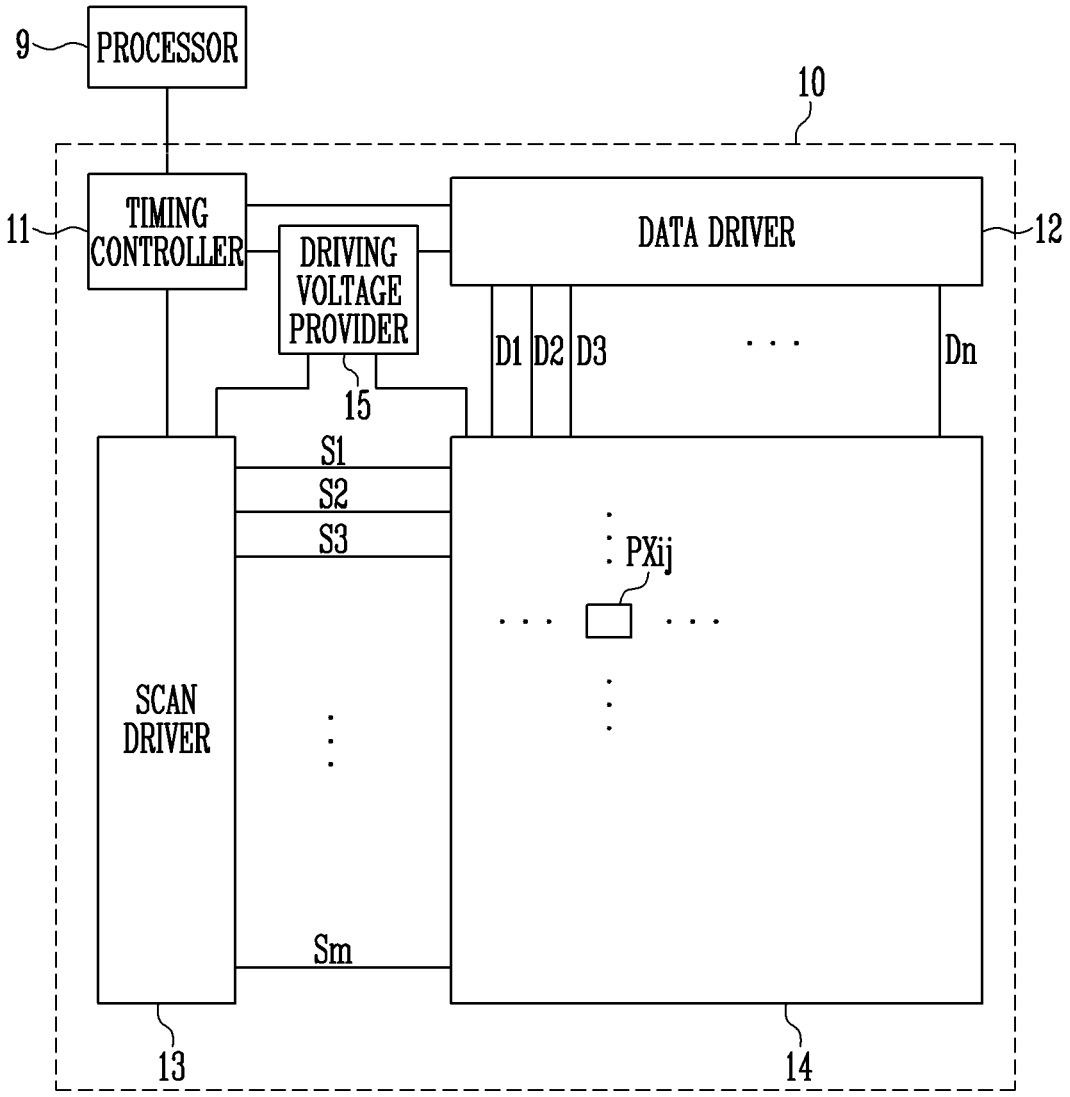
FIG. 1 is a diagram illustrating a display device according to an embodiment of the present disclosure.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a diagram illustrating a display device according to an exemplary embodiment of the present disclosure.

Referring to FIG. 1, the display device 10 according to the exemplary embodiment of the present disclosure may include a timing controller 11, a data driver 12, a scan driver 13, a pixel unit 14, and a driving voltage provider 15.

A processor 9 may be a general-purpose processing device. For example, the processor 9 may be an application processor (AP), a central processing unit (CPU), a graphics processing unit (GPU), a micro-controller unit (MCU), a host system, etc.

The processor 9 may provide the timing controller 11 with control signals required to display an image frame and gray scale values for each pixel. The control signals may include, for example, a data enable signal, a vertical synchronization signal, a horizontal synchronization signal, and the like. For example, the data enable signal may be an identifier indicating transmission of gray scale values. The vertical synchronization signal may be an identifier indicating start or end of an image frame. The horizontal synchronization signal may be an identifier indicating start or end of a pixel row.

The timing controller 11 may provide the scan driver 13 with a clock signal, a scan start signal, etc. to satisfy specifications of the scan driver 13, based on the received control signals. Also, the timing controller 11 may provide the data driver 12 with gray scale values and control signals, which are modified or maintained to satisfy specifications of the data driver 12, based on the received gray scale values and control signals.

The data driver 12 may generate data voltages to be provided to data lines D1, D2, D3, . . . , and Dn, using the gray scale values and the control signals, which are received from the timing controller 11. For example, data voltages generated in units of pixel rows may be simultaneously applied to the data lines D1 to Dn in response to an output control signal included in a control signal.

The scan driver 13 may generate scan signals to be provided to scan lines S1, S2, S3, . . . , and Sm by receiving control signals including a clock signal, a scan start signal, and the like from the timing controller 11. The scan driver 13 may provide scan signals through the scan lines S1 to Sm, to select at least some of pixels in which data voltages are to be written. For example, the scan driver 13 may sequentially provide scan signals having a turn-on level to the scan lines S1 to Sm, to select a pixel row to which data voltages are to be written. The scan driver 13 may be configured in the form of a shift register, and generate scan signals in a manner that sequentially transfers the scan start signal to a next stage circuit under the control of the clock signal.

The pixel unit 14 includes pixels. Each pixel PXij may be coupled to a corresponding data line and a corresponding scan line. For example, when data voltages for one pixel row are applied to the data lines D1 to Dn from the data driver 12, the data voltages may be written to a pixel row located at a scan line that receives a scan signal having the turn-on level from the scan driver 13. Such a driving method will be described in more detail with reference to FIGS. 2 and 3.

The driving voltage provider 15 may generate a PWM signal according to the frequency of a clock signal, and provide a driving voltage generated according to the duty ratio of the PWM signal to at least one of the pixel unit 14, the data driver 12, and the scan driver 13. The clock signal may be different from that provided from the timing controller 11 to the scan driver 13. The driving voltage provider 15 will be described in more detail later with reference to FIG. 5.

Figure 2:
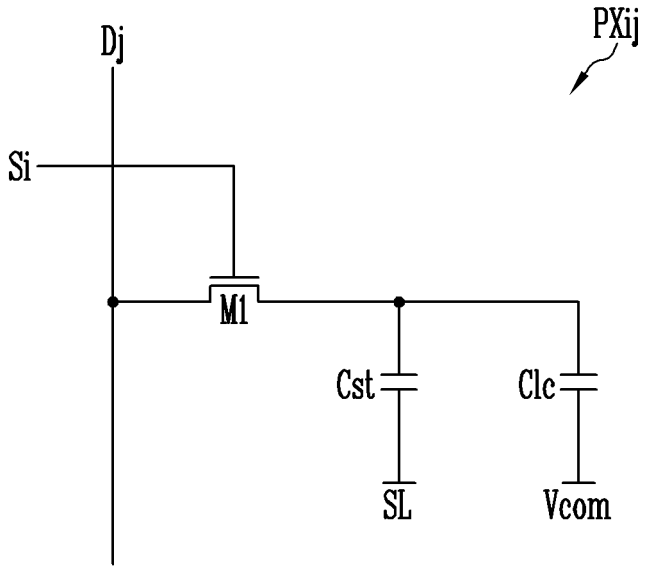
FIG. 2 is a diagram illustrating a pixel according to an embodiment of the present disclosure.

FIG. 2 is a diagram illustrating a pixel according to an exemplary embodiment of the present disclosure.

Referring to FIG. 2, the pixel PXij may include a transistor M1, a storage capacitor Cst, and a liquid crystal capacitor Clc.

The pixel PXij of FIG. 2 may be employed when the display device 10 of FIG. 1 is a liquid crystal display device.

In this exemplary embodiment, the transistor M1 is illustrated as an N-type transistor, and therefore, the turn-on level of a scan signal may be a high level. Those skilled in the art may implement a pixel circuit performing the same function, using a P-type transistor.

A gate electrode of the transistor M1 may be coupled to a scan line Si, one electrode of the transistor M1 may be coupled to a data line Dj, and the other electrode of the transistor M1 may be coupled to one electrode of the storage capacitor Cst and a pixel electrode of the liquid crystal capacitor Clc.

The one electrode of the storage capacitor Cst may be coupled to the other electrode of the transistor M1, and the other electrode of the storage capacitor Cst may be coupled to a sustain voltage line SL. In some exemplary embodiments, when the capacity of the liquid crystal capacitor Clc is sufficient, the configuration of the storage capacitor Cst may be excluded.

The pixel electrode of the liquid crystal capacitor Clc may be coupled to the other electrode of the transistor M1, and a common voltage Vcom may be applied to a common electrode of the liquid crystal capacitor Clc.

When the scan signal having the turn-on level is supplied to the gate electrode of the transistor M1 through the scan line Si, the transistor M1 connect the data line Dj and the one electrode of the storage capacitor Cst. Therefore, a voltage corresponding to the difference between a data voltage applied through the data line Dj and a sustain voltage of the sustain voltage line SL is stored in the storage capacitor Cst. The data voltage is sustained at the pixel electrode of the liquid crystal capacitor Clc by the storage capacitor Cst. Thus, an electric field corresponding to the difference between the data voltage and the common voltage is applied to a liquid crystal layer, and the orientation of liquid crystal molecules of the liquid crystal layer is determined according to the electric field. The pixel PXij can emit light with a desired luminance while light of a backlight is passing through the liquid crystal molecules and a polarizing plate.

Figure 3:
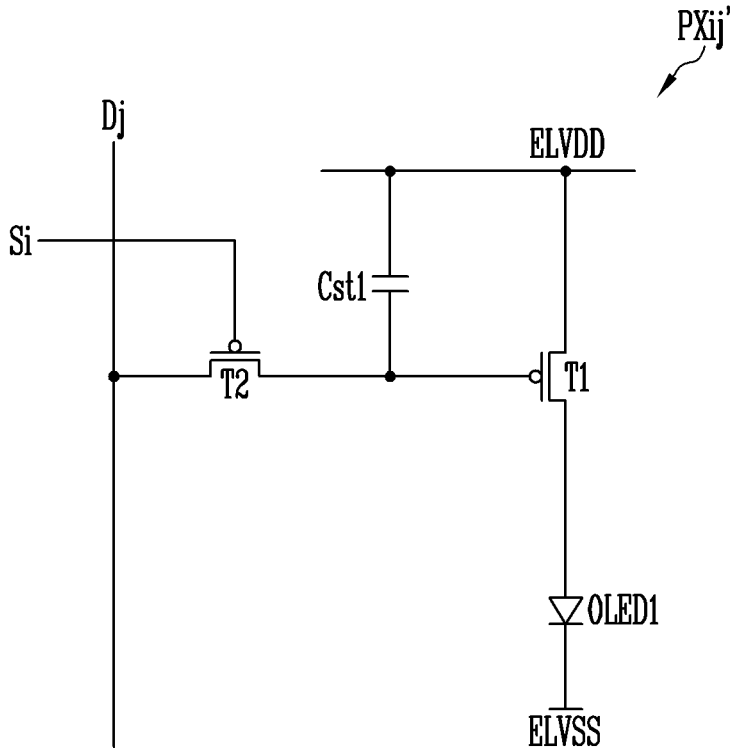
FIG. 3 is a diagram illustrating a pixel according to another embodiment of the present disclosure.

FIG. 3 is a diagram illustrating a pixel according to another exemplary embodiment of the present disclosure.

Referring to FIG. 3, the pixel PXij' may include transistors T1 and T2, a storage capacitor Cst1, and an organic light emitting diode OLED1.

The pixel PXij' of FIG. 3 may be employed when the display device 10 of FIG. 1 is an organic light emitting display device.

In this exemplary embodiment, the transistors T1 and T2 are illustrated as P-type transistors, and therefore, the turn-on level of a scan signal may be a low level. Those skilled in the art may implement a pixel circuit performing the same function, using an N-type transistor.

A gate electrode of the transistor T2 may be coupled to a scan line Si, one electrode of the transistor T2 may be coupled to a data line Dj, and the other electrode of the transistor T2 may be coupled to a gate electrode of the transistor T1. The transistor T2 may be referred to as a switching transistor, a scan transistor, etc.

The gate electrode of the transistor T1 may be coupled to the other electrode of the transistor T2, one electrode of the transistor T1 may be coupled to a first power voltage ELVDD, and the other electrode of the transistor T1 may be coupled to an anode electrode of the organic light emitting diode OLED1. The transistor T1 may be referred to as a driving transistor.

The storage capacitor Cst1 connects the one electrode and the gate electrode of the transistor T1.

The anode electrode of the organic light emitting diode OLED1 may be coupled to the other electrode of the transistor T1, and a cathode electrode of the organic light emitting diode OLED1 may be coupled to a second power voltage ELVSS.

When the scan signal having the turn-on level is supplied to the gate electrode of the transistor T2 through the scan line Si, the transistor T2 connects the data line Dj and one electrode of the storage capacitor Cst1. Therefore, a voltage corresponding to the difference between a data voltage applied through the data line Dj and the first power voltage ELVDD is written in the storage capacitor Cst1. The transistor T1 allows a driving current determined according to the voltage written in the storage capacitor Cst1 to flow from the first power voltage ELVDD to the second power voltage ELVSS. The organic light emitting diode OLED1 emits light with a luminance corresponding to an amount of the driving current.

Figure 4:
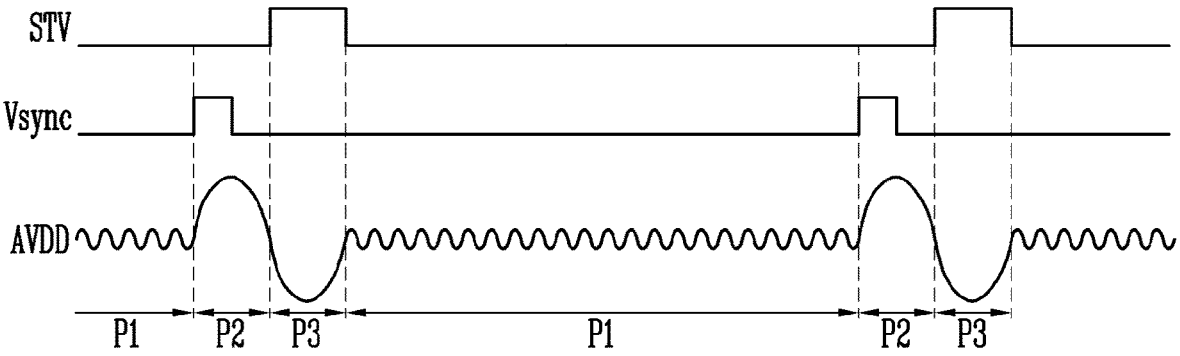
FIG. 4 is a diagram illustrating a driving voltage with respect to a first section, a second section, and a third section of the display device of FIG. 1.

FIG. 4 is a diagram illustrating a driving voltage with respect to a first section, a second section, and a third section of the display device of FIG. 1.

A vertical synchronization signal Vsync may be an identifier indicating start or end of an image frame. The period of the vertical synchronization signal Vsyn may mean the period of the image frame. The low level of the vertical synchronization signal Vsync is referred to a first level, and the high level of the vertical synchronization signal Vsync is referred to as a third level.

A scan start signal STV is provided to the scan driver 13, so that stages of the scan driver 13 can sequentially generate scan signals. The low level of the scan start signal STV is referred to as a second level, and the high level of the scan start signal STV is referred to as a fourth level.

A first section P1 may be referred to as an active section. In the first section P1, the vertical synchronization signal Vsync may have the first level (low level), and the scan start signal STV may have the second level (low level). In the active section, as scan signals and data voltage are supplied in a constant period, a load is constant, and therefore, a change in driving voltage AVDD is relatively small. That is, a ripple of the driving voltage AVDD may be small.

A second section P2 may be referred to as a blank section. At a start time of the second section P2, the vertical synchronization signal Vsync may have the third level (high level). The scan start signal STV may maintain the second level (low level) during the second section P2. Since scan signals and data voltages are not supplied in the blank section, a load in the second section P2 is relatively smaller than that in the first section P1. Therefore, in the second section P2, the driving voltage AVDD may increase as compared with the first section P1. That is, the ripple of the driving voltage AVDD may be large in a positive direction.

A third section P3 may be an initial section of the active section. The third section P3 may be located between the first section P1 and the second section P2. In the third section P3, the vertical synchronization signal Vsync may have the first level (low level), and the scan start signal STV may have the fourth level (high level). Since the supply of data voltages and scan signals is started in the initial section of the active section, a load in the third section P3 is relatively larger than that in the first section P1. Therefore, in the third section P3, the driving voltage AVDD may decrease as compared with the first section P1. That is, the ripple of the driving voltage AVDD may be large in a negative direction.

For example, the driving voltage AVDD may be an AVDD voltage when the display device 10 of FIG. 1 is a liquid crystal display device. The AVDD voltage of the liquid crystal display device is a basic voltage. The AVDD voltage of the liquid crystal display device may be used as a reference voltage for generating gamma voltages in the data driver 12, and be used as a power voltage in a buffer stage coupled to the data lines D1 to Dn. Also, the AVDD voltage may be used to generate a common voltage to be used in the pixel unit 14, and be used to generate a gate-on voltage to be used in the scan driver 13.

In another example, the driving voltage AVDD may correspond to various voltages when the display device 10 of FIG. 1 is an organic light emitting display device. For example, the driving voltage AVDD may be the first power voltage ELVDD or the second power voltage ELVSS, which is used in the pixel PXij'. Also, the driving voltage AVDD may be a VDD voltage (high voltage) to be used in the scan driver 13. Also, the driving voltage AVDD may be used as a reference voltage for generating gamma voltages in the data driver 12, and be used as a power voltage in a buffer stage coupled to the data lines D1 to Dn.

Figure 5:
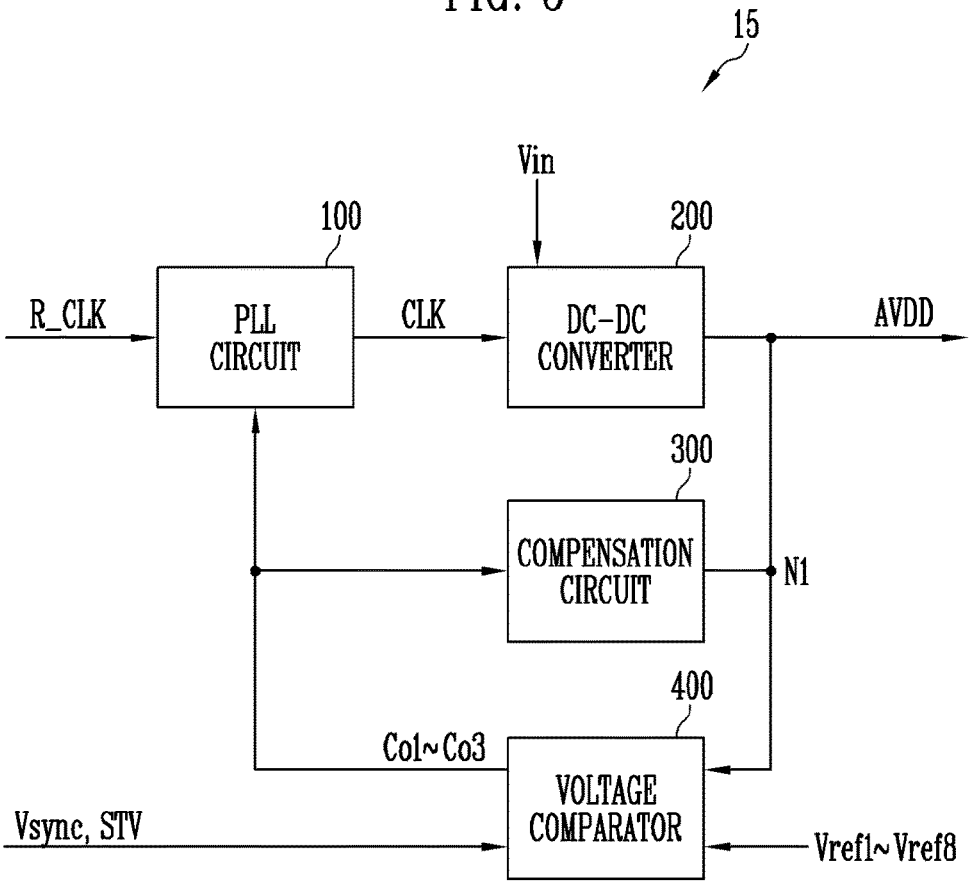
FIG. 5 is a diagram illustrating a driving voltage provider of the display device of FIG. 1.

FIG. 5 is a diagram illustrating a driving voltage provider of the display device of FIG. 1.

Referring to FIG. 5, the driving voltage provider 15 may include a PLL circuit 100, a DC-DC converter 200, a compensation circuit 300, and a voltage comparator 400.

The PLL circuit 100 may generate a clock signal CLK with reference to a reference clock signal R_CLK and output values Co1 to Co3 of the voltage comparator 400.

The DC-DC converter 200 may generate a PWM signal according to the frequency of the clock signal CLK, and generate a driving voltage AVDD, using an input voltage Vin according to the duty ratio of the PWM signal.

The voltage comparator 400 may measure a magnitude of the driving voltage AVDD, using reference voltages Vref1 to Vref8. For example, the voltage comparator 400 may measure magnitudes of the driving voltage AVDD in a first section P1, a second section P2, and a third section P3. The voltage comparator 400 may provide the measured magnitudes of the driving voltage AVDD as the output values Co1 to Co3.

For example, the voltage comparator 400 may be operated in the first section P1, the second section P2, and the third section P3, using, as a control signal, logic levels of the vertical synchronization signal Vsync and the scan start signal STV, which are provided from the timing controller 11. Referring back to the description of FIG. 4, when the vertical synchronization signal Vsync has the first level and the scan start signal STV has the second level, the voltage comparator 400 may be operated in the first section P1. When the vertical synchronization signal Vsync has the third level different from the first level and the scan start signal STV has the second level, the voltage comparator 400 may be operated in the second section P2. When the vertical synchronization signal Vsync has the first level and the scan start signal STV has the fourth level different from the second level, the voltage comparator 400 may be operated in the third section P3.

The compensation circuit 300 may be coupled to a first node N1 to which the driving voltage AVDD is provided, and determine a response speed with respect to the driving voltage AVDD with reference to the output values Co1 to Co3 of the voltage comparator 400.

Figure 6:
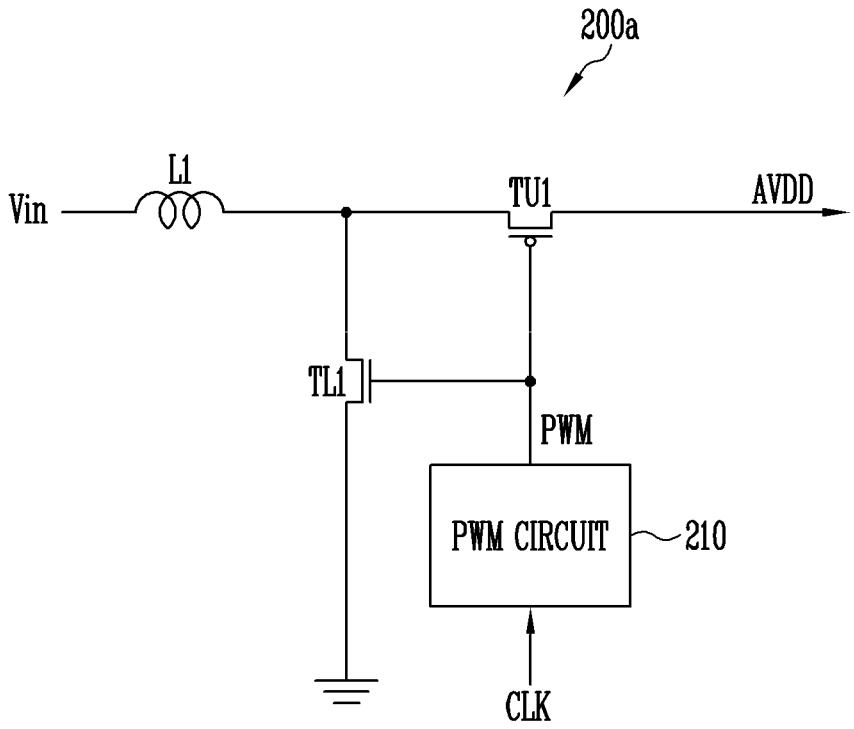
FIG. 6 is a diagram illustrating a DC-DC converter of the driving voltage provider of FIG. 5 according to an embodiment of the present disclosure.

FIG. 6 is a diagram illustrating a DC-DC converter of the driving voltage provider of FIG. 5 according to an exemplary embodiment of the present disclosure.

Referring to FIG. 6, the DC-DC converter 200*a* may be a boost converter. The DC-DC converter 200*a* may include transistors TU1 and TL1, an inductor L1, and a PWM circuit 210.

The PWM circuit 210 may generate a PWM signal PWM having a period corresponding to the frequency of the clock signal CLK. The PWM signal PWM may have an on/off duty ratio, and alternately turn on/off the transistors TL1 and TU1. The duty ratio of the PWM signal PWM may be determined independently from the frequency of the clock signal CLK.

First, when the transistor TL1 is turned on and the transistor TU1 is turned off, energy is stored in the inductor L1 while the current of the inductor L1 is increasing. Next, when the transistor TL1 is turned off and the transistor TU1 is turned on, the energy of the inductor L1 is discharged while the current of the inductor L1 is decreasing. Therefore, a driving voltage AVDD amplified by adding an input voltage Vin and the current flowing from the inductor L1 is output. When the duty ratio of the PWM signal PWM increases, the driving voltage AVDD can be further amplified.

Figure 7:
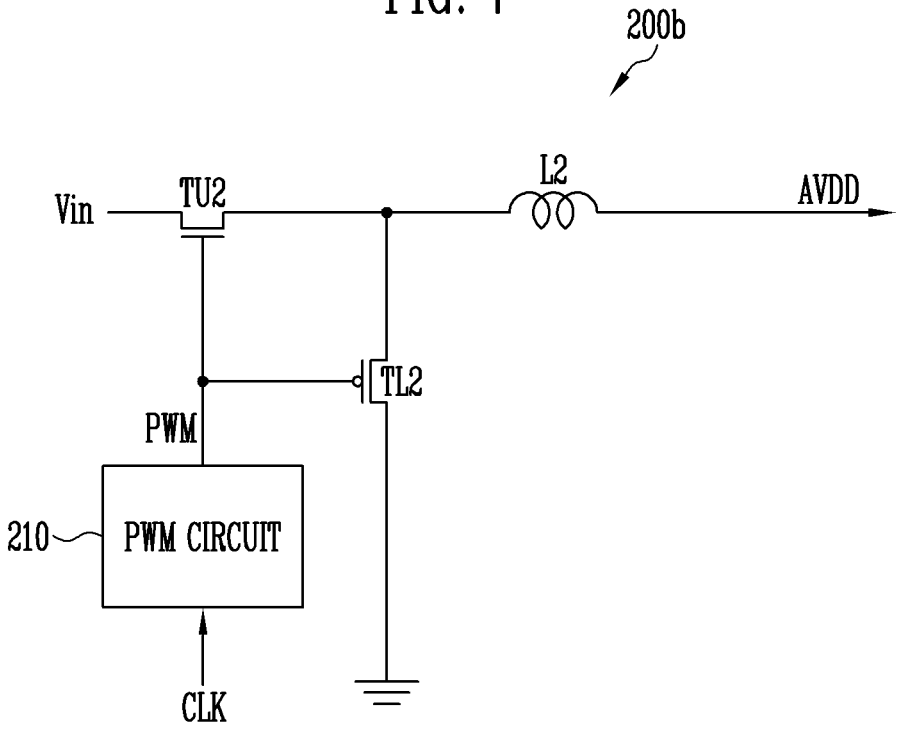
FIG. 7 is a diagram illustrating a DC-DC converter of the driving voltage provider of FIG. 5 according to another embodiment of the present disclosure.

FIG. 7 is a diagram illustrating a DC-DC converter of the driving voltage provider of FIG. 5 according to another exemplary embodiment of the present disclosure.

Referring to FIG. 7, the DC-DC converter 200*b* may be a buck converter. The DC-DC converter 200*b* may include transistors TU2 and TL2, an inductor L2, and a PWM circuit 210.

The PWM circuit 210 may generate a PWM signal PWM having a period corresponding to the frequency of the clock signal CLK. The PWM signal PWM may have an on/off duty ratio, and alternately turn on/off the transistors TL2 and TU2. The duty ratio of the PWM signal PWM may be determined independently from the frequency of the clock signal CLK.

First, when the transistor TU2 is turned on and the transistor TL2 is turned off, energy is stored in the inductor L2 while the current of the inductor L2 is increasing. Next, when the transistor TU2 is turned off and the transistor TL2 is turned on, the energy of the inductor L2 is discharged while the current of the inductor L2 is decreasing. Since an input voltage Vin is separated from an output terminal, a decreased driving voltage AVDD is output based on only a current flowing from the inductor L2. When the duty ratio of the PWM signal PWM decreases, the driving voltage AVDD can be further decreased.

A case where the boost converter and the buck converter exist independently from each other is described in FIGS. 6 and 7. However, in another exemplary embodiment, various converters known in the art, such as a buck-boost converter in which a boost converter and a buck converter are integrated, a Cuk converter, and a flyback converter, may be employed as the DC-DC converter 200.

Figure 8:
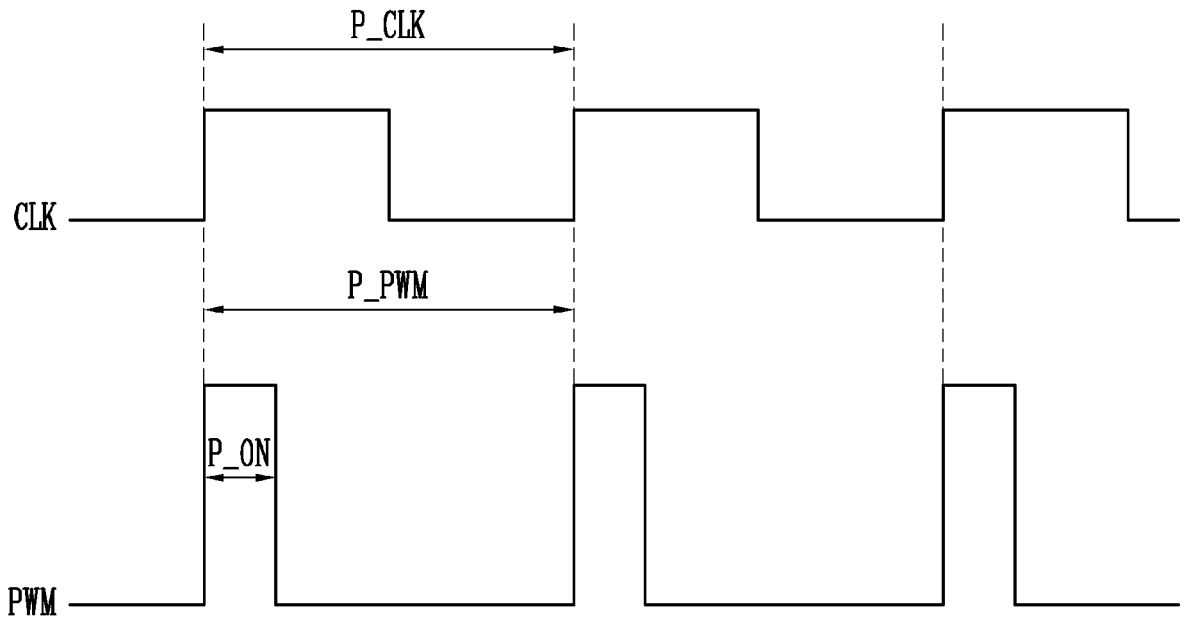
FIG. 8 is a diagram illustrating a relationship between a clock signal and a PWM signal.

FIG. 8 is a diagram illustrating a relationship between the clock signal and the PWM signal.

The frequency of the clock signal CLK may be determined to have a period P_CLK.

The PWM signal PWM may have a period P_PWM corresponding to the frequency of the clock signal CLK. In an example, the PWM circuit 210 may be configured such that the period P_PWM of the PWM signal PWM is equal to that P_CLK of the clock signal CLK. In another example, the PWM circuit 210 may be configured such that the period P_PWM of the PWM signal PWM becomes integer times or fractional times of the period P_CLK of the clock signal CLK.

The PWM signal PWM may have a duty ratio. The duty ratio may mean a ratio of on-time P_ON to one period P_PWM. That is, the duty ratio may increase when the on-time P_ON is lengthened.

The magnitude of the driving voltage AVDD output from the DC-DC converter 200 depends on the duty ratio of the PWM signal PWM, and may not depend on the period P_PWM of the PWM signal PWM.

When the period P_PWM of the PWM signal PWM is shortened, the ripple of the driving voltage AVDD may be decreased, but the thermal stress of the driving voltage provider 15 may be increased. On the contrary, when the period P_PWM of the PWM signal PWM is lengthened, the ripple of the driving voltage AVDD may be increased, but the thermal stress of the driving voltage provider 15 may be decreased.

In the exemplary embodiments of the present disclosure, the period P_PWM of the PWM signal PWM is appropriately set for each section, so that the control of the ripple of the driving voltage AVDD and the control of thermal stress can be appropriately balanced.

The driving voltage provider 15 may tune the frequency of the clock signal CLK to a first frequency in the first section P1, tune the frequency of the clock signal CLK to a second frequency smaller than the first frequency in the second section P2 in which the magnitude of the driving voltage AVDD is larger than that in the first section P1, and tune the frequency of the clock signal CLK to a third frequency larger than the first frequency in the third section P3 in which the magnitude of the driving voltage AVDD is smaller than that in the first section P1.

That is, based on the first section P1 that is the active section, the frequency of the clock signal CLK is decreased in the second section P2 in which a load is relatively small, so that the period P_PWM of the PWM signal PWM can be lengthened. Accordingly, as compared with the first period P1, the ripple of the driving voltage AVDD may be increased, but the thermal stress may decrease. Since it is unnecessary to provide scan signals and data voltage to the pixel unit 14 in the second section P2, a display change caused by an increase in the ripple of the driving voltage AVDD does not occur, or the degree of display change may be slight. Thus, according to this exemplary embodiment, the thermal stress of the driving voltage provider 15 in the second section P2 can be decreased.

Also, based on the first section P1 that is the active section, the frequency of the clock signal CLK is increased in the third section P3 in which a load is relatively large, so that the period P_PWM of the PWM signal PWM can be shortened. Accordingly, as compared with the first section P1, the thermal stress increases, but the ripple of the driving voltage AVDD may be decreased. Since scan signals and data voltages start being provided to the pixel unit 14 in the third section P3, a display change may occur when the ripple of the driving voltage AVDD is large. Thus, according to this exemplary embodiment, the ripple of the driving voltage AVDD can be decreased in the third section P3.

Figure 9:
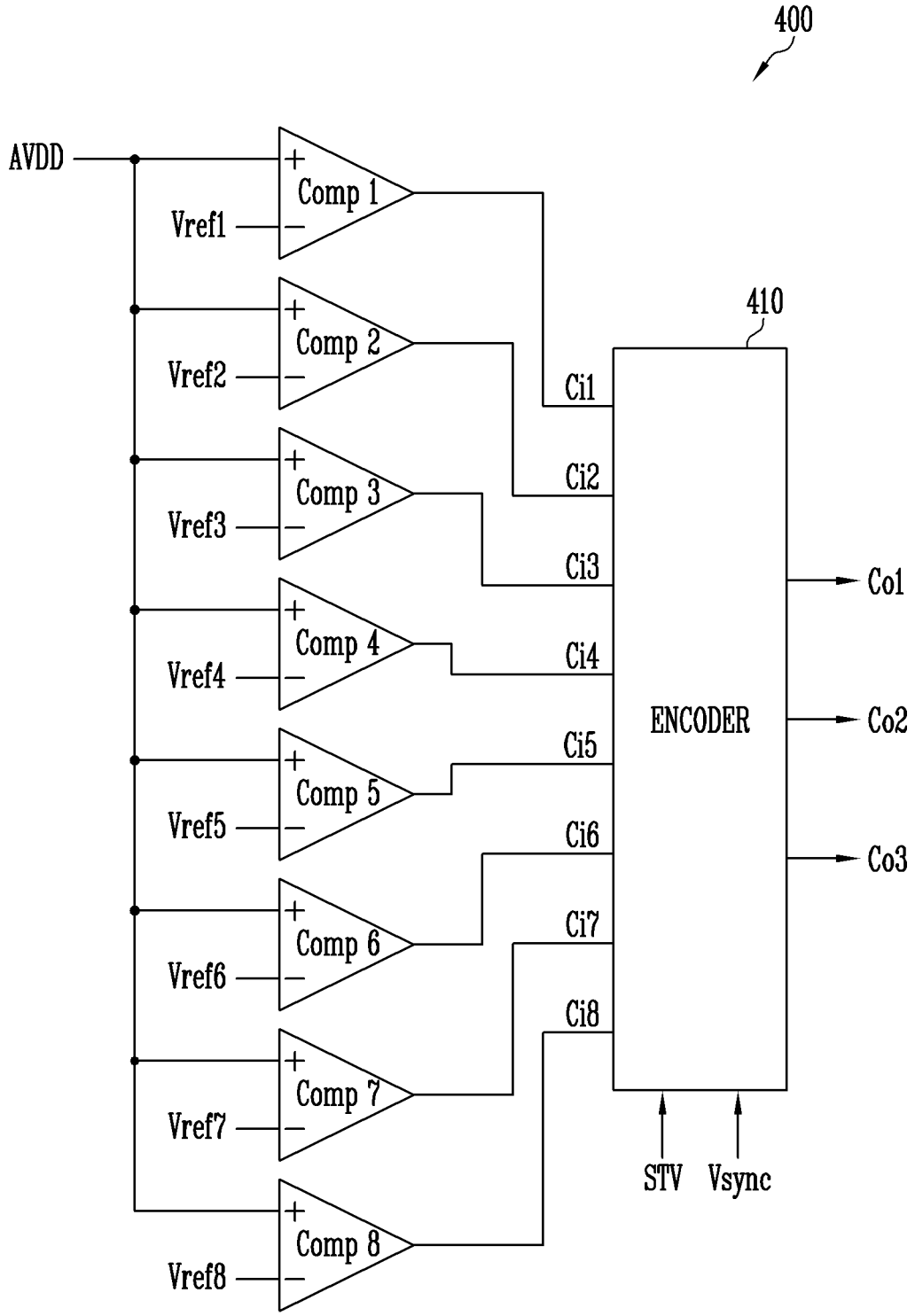
FIG. 9 is a diagram illustrating a voltage comparator of the driving voltage provider of FIG. 5 according to an embodiment of the present disclosure.
Figures 10, 11:
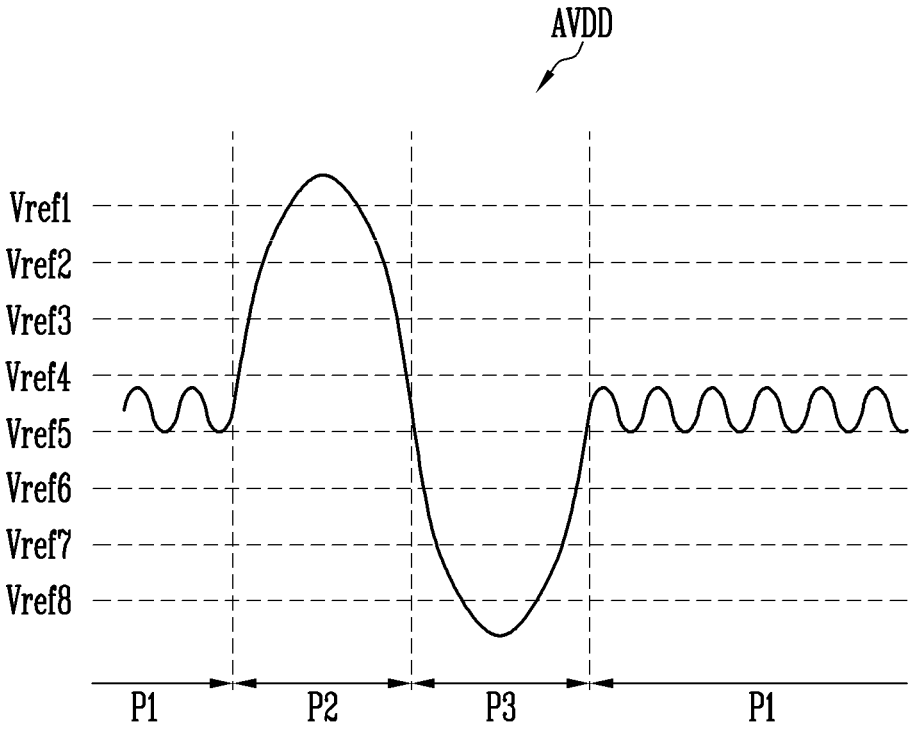
FIGS. 10 and 11 are diagrams illustrating an exemplary operation of the voltage comparator of FIG. 9.

FIG. 9 is a diagram illustrating a voltage comparator of the driving voltage provider of FIG. 5 according to an exemplary embodiment of the present disclosure. FIGS. 10 and 11 are diagrams illustrating an exemplary operation of the voltage comparator of FIG. 9.

The voltage comparator 400 may include comparators Comp1 to Comp 8 and an encoder 410.

The driving voltage AVDD and different reference voltages Vref1 to Vref8 may be input to the comparators Comp1 to Comp 8.

The encoder 410 may encode outputs Ci1 to Ci8 of the comparators Comp1 to Comp 8 according to logic levels of the vertical synchronization signal Vsync and the scan start signal STV. An operation timing of the encoder 410 according to the logic levels of the vertical synchronization signal Vsync and the scan start signal STV refers to the description of the voltage comparator 400 of FIG. 5.

However, the voltage level of the driving voltage AVDD may be fluctuated even in each section, and therefore, at which time of each section the encoder 410 is to operate may be problematic.

According to an exemplary embodiment, the encoder 410 may encode a maximum value of the driving voltage AVDD, which is measured when the encoder 410 operates plural times in the second section P2, and provide the maximum value as one of the output values Co1, Co2, and Co3. That is, the output values Co1, Co2, and Co3 are binary numerals, the encoder 410 may output the maximum value. Also, the encoder 410 may encode a minimum value of the driving voltage AVDD, which is measured when the encoder 410 operates plural times in the third section P3, and provide the minimum value as one of the output values Co1, Co2, and Co3. That is, the output values Co1, Co2, and Co3 are binary numerals, the encoder 410 may output the minimum value. Also, the encoder 410 may encode an average value of the driving voltage AVDD, which is measured when the encoder 410 operates plural times in the first section P1, and provide the average value as of the output values Co1, Co2, and Co3. That is, the output values Co1, Co2, and Co3 are binary numerals, the encoder 410 may output the average value.

According to another exemplary embodiment, the encoder 410 may operate once in each section, and the operation timing of the encoder may be preset suitable for products. That is, a manufacturer may repeatedly measure, in advance, a waveform corresponding to times of each section of the driving voltage AVDD. Therefore, the encoder 410 may be configured to operate at a time at which the maximum value of the driving voltage AVDD is expected, and be configured to operate at a time at which the minimum value of the driving voltage AVDD is expected. A change in the driving voltage AVDD is not large in the first section P1, and hence, an appropriate time can be selected.

Referring to the waveform of FIG. 10 and the table of FIG. 11, it can be seen that the output values Co1, Co2, and Co3 increase when the magnitude of the driving voltage AVDD increases.

Figures 12, 13:
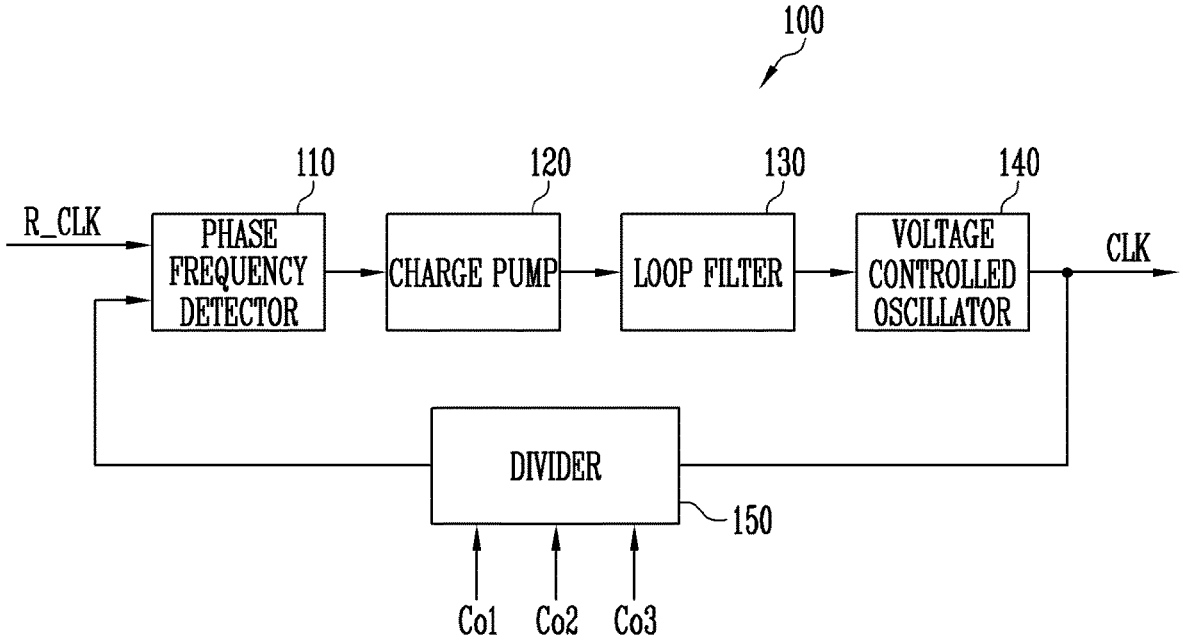
FIG. 12 is a diagram illustrating a PLL circuit of the driving voltage provider of FIG. 5 according to an embodiment of the present disclosure.
FIG. 13 is a diagram illustrating an exemplary operation of the PLL circuit of FIG. 12.

FIG. 12 is a diagram illustrating a PLL circuit of the driving voltage provider of FIG. 5 according to an exemplary embodiment of the present disclosure. FIG. 13 is a diagram illustrating an exemplary operation of the PLL circuit of FIG. 12.

The PLL circuit 100 may include a phase frequency detector 110, a charge pump 120, a loop filter 130, a voltage controlled oscillator 140, and a divider 150.

The phase frequency detector 110 may compare a reference clock signal R_CLK and an output signal of the divider 150, and generate an up signal or a down signal such that the phase and frequency of the output signal of the divider 150 are equal to those of the reference clock signal R_CLK.

The charge pump 120 may increase the supply of charges in response to the up signal output from the phase frequency detector 110, and decrease the supply of charges in response to the down signal.

The loop filter 130 may include, for example, a capacitor, and generate a control voltage with respect to ground at one terminal of the capacitor, corresponding to an amount of charges supplied by the charge pump 120. The control voltage may be applied to the voltage controlled oscillator 140, and the voltage controlled oscillator 140 may generate a clock signal CLK of which frequency or phase is controlled according to the control voltage.

The divider 150 may divide and output the clock signal CLK according to a divider value DIV.

For example, when the frequency of the reference clock signal R_CLK is 100 KHz, and the divider value DIV is 1, the frequency of the clock signal CLK output from the PLL circuit 100 may be 100 KHz. In order to increase the frequency of the clock signal CLK, the divider value DIV may be increased. For example, when the divider value DIV is increased to 2, the output signal of the divider 150 may be a similar clock signal having a frequency of 50 KHz. The phase frequency detector 110 may output the up signal and the down signal such that the frequency of the similar clock signal, which is 50 KHz, is tuned to that of the reference clock signal R_CLK, which is 100 KHz. Consequently, the frequency of the clock signal CLK is increased up to 200 KHz such that the frequencies of the output signal of the divider 150 and the reference clock signal R_CLK correspond to each other. On the contrary, when the divider value DIV is decreased, the frequency of the clock signal CLK is decreased.

Referring to the table of FIG. 13, the divider 150 may be configured such that the output values Co1, Co2, and Co3 of the voltage comparator 400 and the divider value are in inverse proportion to each other. That is, when the output values Co1, Co2, and Co3 of the voltage comparator 400 increase, the divider value may decrease.

Accordingly, as described with reference to FIG. 8, the frequency of the clock signal CLK in the second section P2 can be decreased as compared with the first section P1, and the frequency of the clock signal CLK in the third section P3 can be increased as compared with the first section P1.

Figures 14, 15:
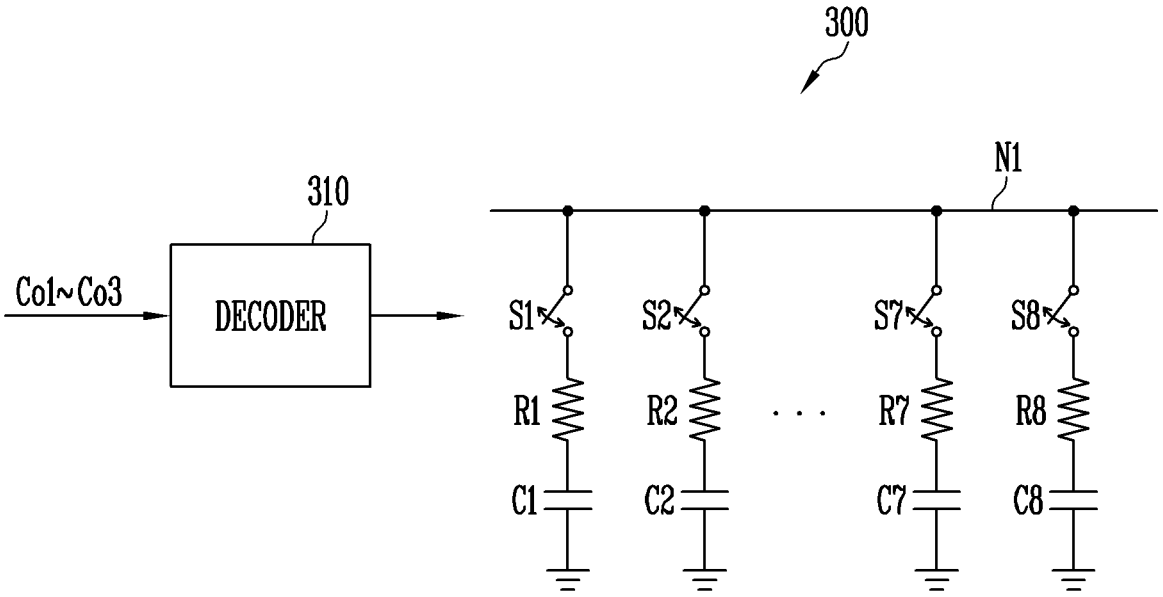
FIG. 14 is a diagram illustrating a compensation circuit of the driving voltage provider of FIG. 5 according to an embodiment of the present disclosure.
FIG. 15 is a diagram illustrating an exemplary operation of the compensation circuit of FIG. 14.

FIG. 14 is a diagram illustrating a compensation circuit of the driving voltage provider of FIG. 5 according to an exemplary embodiment of the present disclosure. FIG. 15 is a diagram illustrating an exemplary operation of the compensation circuit of FIG. 14.

The compensation circuit 300 may be coupled to a first node N1 to which a driving voltage AVDD is provided, and determine a response speed with respect to the driving voltage AVDD with reference to output values Co1 to Co3 of the voltage comparator 400.

The compensation circuit 300 may include a decoder 310, switches S1 to S8, resistors R1 to R8, and capacitors C1 to C8.

The compensation circuit 300 may tune the response speed with respect to the driving voltage AVDD to a first speed in the first section P1, tune the response speed with respect to the driving voltage AVDD to a second speed slower than the first speed in the second section P2, and tune the response speed with respect to the driving voltage AVDD to a third speed faster than the first speed in the third section P3.

As described above, in the second section P2, the reduction of thermal stress is required rather than the compensation of the ripple of the driving voltage AVDD, and therefore, the response speed is preferably set to decrease. Also, in the third section P3, the compensation of the ripple of the driving voltage AVDD is required rather than the reduction of thermal stress, and therefore, the response speed is preferably set to increase.

The response speed refers to a speed at which the output driving voltage AVDD is fed back, and may be expressed as a feedback bandwidth.

A time constant may be increased so as to decrease the response speed. The time constant may be decreased so as to increase the response speed.

At least some of the resistors R1 to R8 and the capacitors C1 to C8 may be coupled to the first node N1 such that the compensation circuit 300 has a time constant corresponding to the first speed in the first section P1. At least some of the resistors R1 to R8 and the capacitors C1 to C8 may be coupled to the first node N1 such that the compensation circuit 300 has a time constant corresponding to the second speed in the second section P2. At least some of the resistors R1 to R8 and the capacitors C1 to C8 may be coupled to the first node N1 such that the compensation circuit 300 has a time constant corresponding to the third speed in the third section P3.

The decoder 310 may selectively turn on one of the switches S1 to S8, corresponding to an input Co1, Co2, and Co3 (see FIG. 15). For example, a first switch S1 may be turned on when the input Co1, Co2, and Co3 is smallest, and an eighth switch S8 may be turned on when the input Co1, Co2, and Co3 is largest. For example, the time constant may increase when the resistance of a resistor increases. In addition, the time constant may decrease when the capacitance of a capacitor increases. Therefore, the resistance of a resistor R1 coupled to the first switch S1 may be set largest, and the capacitance of a capacitor C1 coupled to the first switch S1 may be set smallest. Similarly, the resistance of a resistor R8 coupled to the eighth switch S8 may be set smallest, and the capacitance of a capacitor C8 coupled to the eighth switch S8 may be set largest. Resistances of the other resistors R2 to R7 may be set as sequential values between the resistance of the resistor R1 and the resistance of the resistor R8, and capacitances of the other capacitors C2 to C7 may be set as sequential values between the capacitance of the capacitor C1 to the capacitance of the capacitor C8.

In another exemplary embodiment, values of the resistors R1 to R8 and the capacitors C1 to C8 may be differently set. In order to decrease the response speed in the second section P2, the frequency of the clock signal CLK may be decreased, and zero frequency may be increased. In order to increase the response speed in the third section P3, the frequency of the clock signal CLK may be increases, and the zero frequency may be decreased. The values of the resistors R1 to R8 and the capacitors C1 to C8 may be set to satisfy such a condition.

Figure 16:
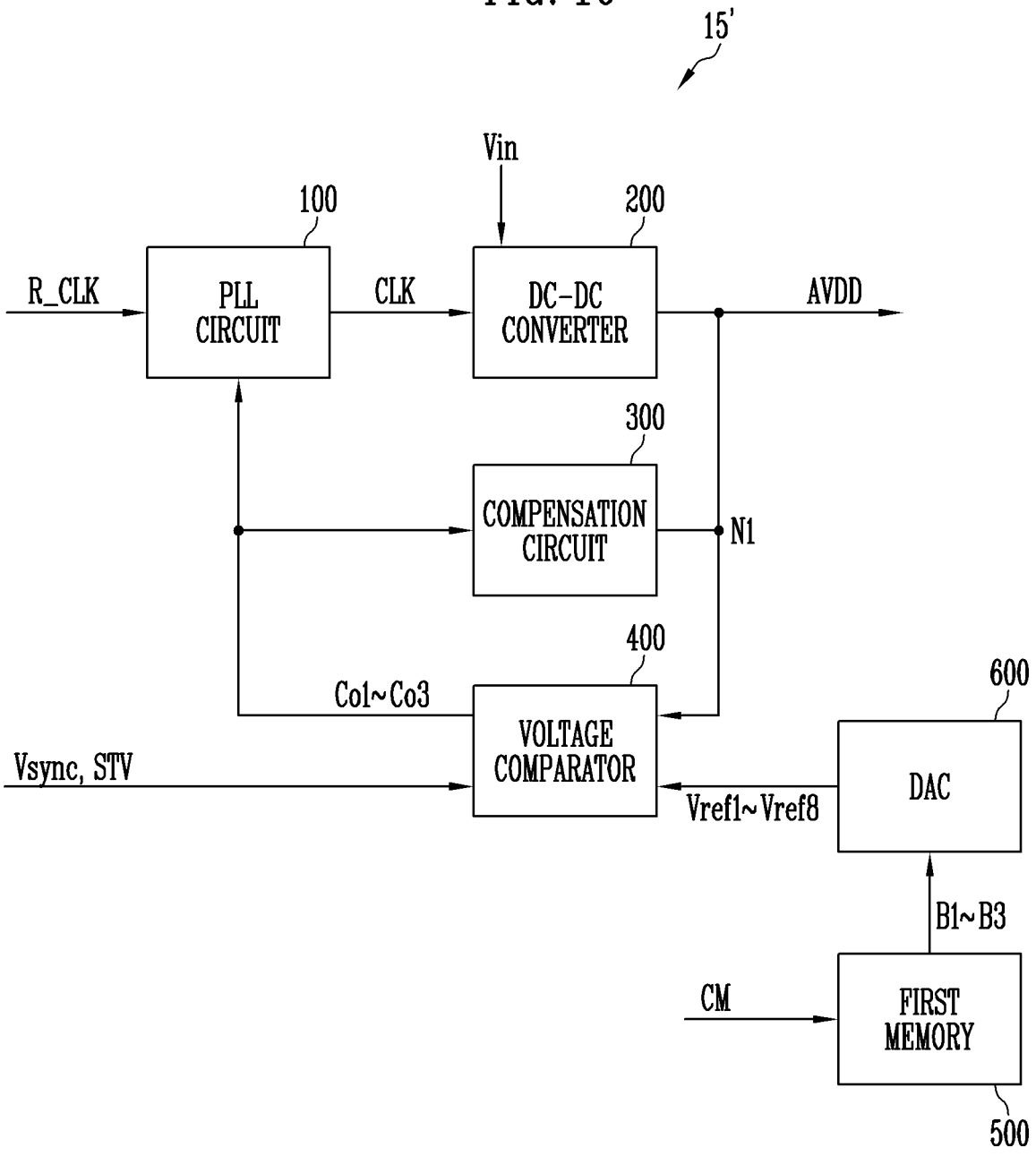
FIG. 16 is a diagram illustrating a driving voltage provider according to another embodiment of the present disclosure.

FIG. 16 is a diagram illustrating a driving voltage provider according to another exemplary embodiment of the present disclosure.

As compared with the driving voltage provider 15 of FIG. 5, the driving voltage provider 15' of FIG. 16 further includes a first memory 500 and a digital-analog converter (DAC) 600. Redundant descriptions of the existing components of the driving voltage provider 15 of FIG. 5 will be omitted.

The first memory 500 may output a digital value B1 to B3 under the control of the timing controller 11. For example, the timing controller 11 may provide a control signal CM to the first memory 500 through an I2C interface. For example, the first memory 500 may be an EEPROM.

The DAC 600 may convert the digital value B1 to B3 into reference voltages Vref1 to Verf8.

Accordingly, the timing controller 11 may modify the reference voltages Vref1 to Verf8 to be suitable for a situation.

In the above-described exemplary embodiments, the driving voltage provider 15 is controlled using information of three bits. However, those skilled in the art employ a DAC capable of processing a large number of bits, so that the driving voltage provider can control the driving voltage AVDD with a high resolution.

Figure 17:
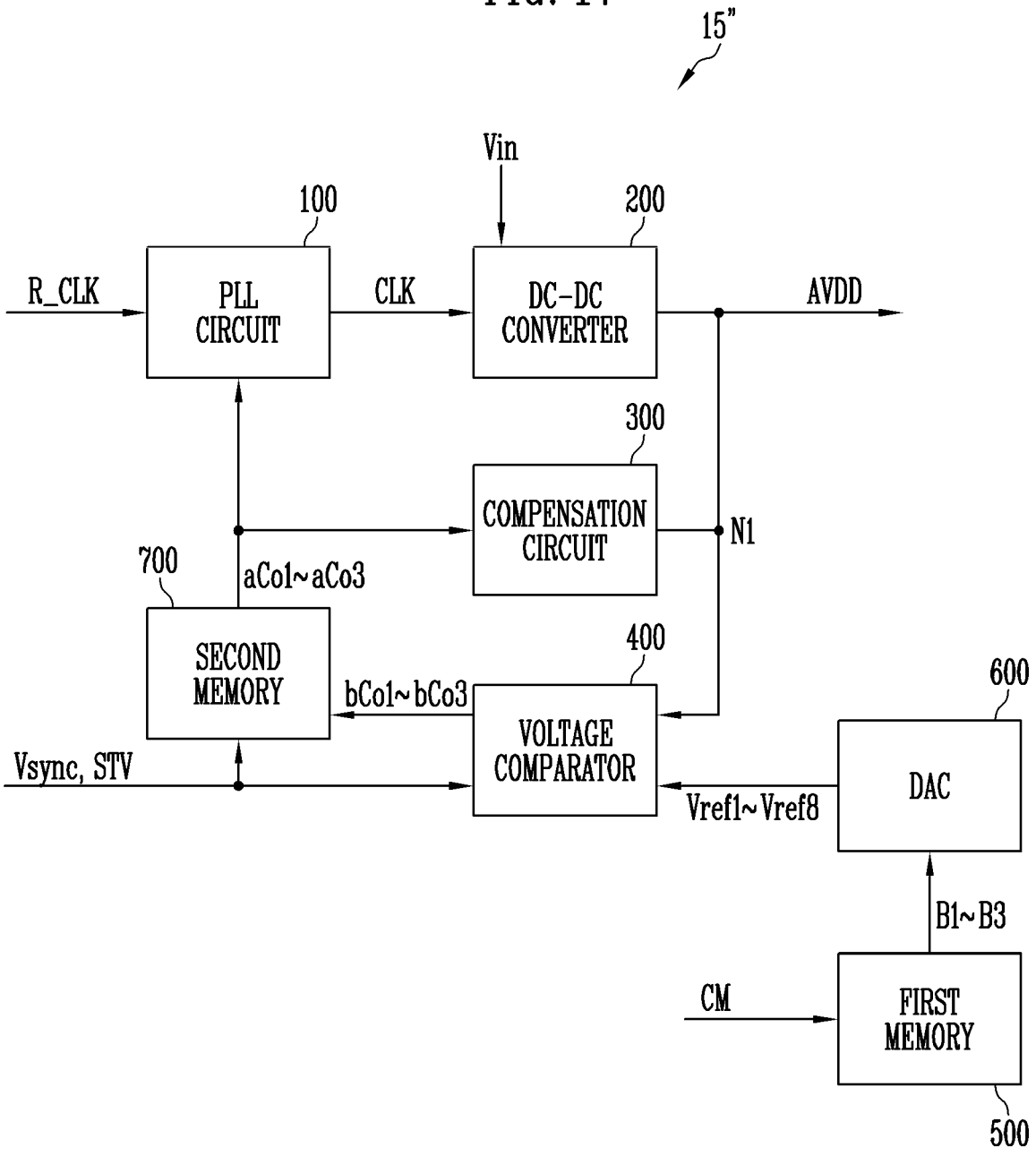
FIG. 17 is a diagram illustrating a driving voltage provider according to still another embodiment of the present disclosure.

FIG. 17 is a diagram illustrating a driving voltage provider according to still another exemplary embodiment of the present disclosure.

As compared with the driving voltage provider 15' of FIG. 16, the driving voltage provider 15" of FIG. 17 further includes a second memory 700. Redundant descriptions of the existing components of the driving voltage provider 15' of FIG. 16 will be omitted.

The second memory 700 may store output values of the voltage comparator 400 in the first section P1, the second section P2, and the third section P3 by using, as a control signal, logic levels of the vertical synchronization signal Vsync and the scan start signal STV.

A method of searching for a timing at which the output values of the voltage comparator 400 in the first section P1, the second section P2, and the third section P3 are to be stored using the logic levels of the vertical synchronization signal Vsync and the scan start signal STV refers to the descriptions of FIGS. 9 to 11.

According to this exemplary embodiment, it is unnecessary for the voltage comparator 400 to operate for each image frame, and thus power consumption can be reduced. For example, the voltage comparator 400 may measure a magnitude of the driving voltage AVDD by using, as a period, a specific number of image frames, and output an output value bCo1 to bCo3. The second memory 700 may store the output value bCo1 to bCo3, and output an output value aCo1 to aCo3 corresponding to the first section P1, the second section P2, and the third section P3 of each image frame, using the output value bCo1 to bCo3.

The driving voltage provider and the display device including the same according to the present disclosure can compensate ripples and minimize thermal stress, adaptively with respect to fluctuation of a load to which a driving voltage is provided.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

pixels coupled to data lines and scan lines;

a data driver configured to provide data voltages through the data lines;

a scan driver configured to provide scan signals through the scan lines, to select at least some of the pixels in which the data voltages are to be written; and a driving voltage provider configured to generate a pulse width modulation (PWM) signal according to a frequency of a clock signal, and provide a driving voltage generated according to a duty ratio of the PWM signal to at least one of the pixels, the data driver, and the scan driver, wherein the driving voltage provider is configured to tune the frequency of the clock signal to a first frequency in a first section, tune the frequency of the clock signal to a second frequency smaller than the first frequency in a second section in which a magnitude of a driving voltage is larger than a magnitude of a driving voltage in the first section, and tune the frequency of the clock signal to a third frequency larger than the first frequency in a third section in which the magnitude of a driving voltage is smaller than the magnitude of a driving voltage in the first section.

2. The display device of claim 1, wherein the driving voltage provider further comprises a voltage comparator configured to measure a magnitude of the driving voltage in each of the first section, the second section, and the third section.

3. The display device of claim 2, wherein the voltage comparator is operated in the first section, the second section, and the third section by using logic levels of a vertical synchronization signal and a scan start signal as a control signal.

4. The display device of claim 3, wherein the voltage comparator:

is operated in the first section when the vertical synchronization signal has a first level and the scan start signal has a second level;

is operated in the second section when the vertical synchronization signal has a third level different from the first level and the scan start signal has the second level; and is operated in the third section when the vertical synchronization signal has the first level and the scan start signal has a fourth level different from the second level.

5. The display device of claim 4, wherein the voltage comparator comprises:

comparators, wherein the driving voltage and different reference voltages are input to the comparators; and an encoder configured to encode output values of the comparators according to the logic levels of the vertical synchronization signal and the scan start signal.

6. The display device of claim 5, wherein the driving voltage provider further comprises a phase locked loop (PLL) circuit configured to generate the clock signal, a frequency of the clock signal is tuned by tuning a divider value corresponding to an output one of the output values of the encoder.

7. The display device of claim 5, further comprising a timing controller configured to control the data driver, the scan driver, and the driving voltage provider, wherein the driving voltage provider further comprises:

a first memory configured to output a digital value under the control of the timing controller; and a digital-analog converter configured to convert the digital value into the different reference voltages.

8. The display device of claim 5, wherein the driving voltage provider further comprises a second memory configured to store output values of the voltage comparator in the first section, the second section, and the third section by using the logic levels of the vertical synchronization signal and the scan start signal as a control signal.

9. The display device of claim 1, wherein the driving voltage provider further comprises a compensation circuit coupled to a first node to which the driving voltage is provided, the compensation circuit is configured to determine a response speed with respect to the driving voltage.

10. The display device of claim 9, wherein the compensation circuit is configured to tune the response speed to a first speed in the first section, tune the response speed to a second speed slower than the first speed in the second section, and tune the response speed to a third speed faster than the first speed in the third section.

11. The display device of claim 10, wherein the compensation circuit comprises resistors and capacitors, wherein at least some of the resistors and the capacitors are coupled to the first node to have a time constant corresponding to the first speed in the first section, at least some of the resistors and the capacitors are coupled to the first node to have a time constant corresponding to the second speed in the second section, and at least some of the resistors and the capacitors are coupled to the first node to have a time constant corresponding to the third speed in the third section.

12. A driving voltage provider comprising:

a PLL circuit configured to generate a clock signal; and a DC-DC converter configured to generate a PWM signal according to a frequency of the clock signal, and generate a driving voltage according to a duty ratio of the PWM signal, wherein the driving voltage provider is configured to tune the frequency of the clock signal to a first frequency in a first section, tune the frequency of the clock signal to a second frequency smaller than the first frequency in a second section in which a magnitude of a driving voltage is larger than a magnitude of a driving voltage in the first section, and tune the frequency of the clock signal to a third frequency larger than the first frequency in a third section in which the magnitude of a driving voltage is smaller than the magnitude of the driving voltage in the first section.

13. The driving voltage provider of claim 12, further comprising a voltage comparator configured to measure the magnitude of the driving voltage in each of the first section, the second section, and the third section.

14. The driving voltage provider of claim 13, wherein the voltage comparator comprises:

comparators, wherein the driving voltage and different reference voltages are input to the comparators; and an encoder configured to encode output values of the comparators.

15. The driving voltage provider of claim 14, wherein the PLL circuit is configured to generate the clock signal, wherein the frequency of the clock signal is tuned by tuning a divider value corresponding to one of the output values of the encoder.

16. The driving voltage provider of claim 12, further comprising a compensation circuit coupled to a first node to which the driving voltage is provided, the compensation circuit determining a response speed with respect to the driving voltage.

17. The driving voltage provider of claim 16, wherein the compensation circuit is configured to tune the response speed to a first speed in the first section, tune the response speed to a second speed slower than the first speed in the second section, and tune the response speed to a third speed faster than the first speed in the third section.

18. The driving voltage provider of claim 17, wherein the compensation circuit comprises resistors and capacitors, wherein at least some of the resistors and the capacitors are coupled to the first node to have a time constant corresponding to the first speed in the first section, at least some of the resistors and the capacitors are coupled to the first node to have a time constant corresponding to the second speed in the second section, and at least some of the resistors and the capacitors are coupled to the first node to have a time constant corresponding to the third speed in the third section.

* * * * *